US006969066B2

(12) United States Patent
Ferrarese et al.

(10) Patent No.: US 6,969,066 B2
(45) Date of Patent: Nov. 29, 2005

(54) PASSIVE VACUUM TRANSPORT

(75) Inventors: Steven M. Ferrarese, Rochester, NY (US); John Meyers, Lakeville, NY (US); Mark F. Scholand, Spencerport, NY (US); Scott J. Phillips, W. Henrietta, NY (US); Jacob Eyngorn, Penfield, NY (US); David G. Savini, Fairport, NY (US)

(73) Assignee: Xerox Corporation, Stamford, CT (US)

( * ) Notice: Subject to any disclaimer, the term of this patent is extended or adjusted under 35 U.S.C. 154(b) by 614 days.

(21) Appl. No.: 10/100,648

(22) Filed: Mar. 19, 2002

(65) Prior Publication Data

US 2003/0042665 A1 Mar. 6, 2003

Related U.S. Application Data

(60) Provisional application No. 60/315,422, filed on Aug. 28, 2001.

(51) Int. Cl.[7] ..... B65H 5/00

(52) U.S. Cl. ..... 271/264; 271/272; 271/183; 271/276; 271/194

(58) Field of Search ..... 399/329, 397, 399/400, 406, 320, 322, 324; 271/264, 272, 271/183, 276, 194

(56) References Cited

U.S. PATENT DOCUMENTS

| | | | | |
|---|---|---|---|---|
| 3,879,123 | A | 4/1975 | Fisher | 355/14 |
| 4,058,037 | A | 11/1977 | Tashiro et al. | 83/70 |
| 4,493,548 | A * | 1/1985 | Ateya | 399/400 |
| 5,118,589 | A * | 6/1992 | Aslam et al. | 430/124 |
| 5,228,391 | A * | 7/1993 | DeMoore et al. | 101/420 |
| 6,169,875 | B1 * | 1/2001 | Tidrick | 399/400 |
| 6,270,075 | B1 | 8/2001 | Korhonen et al. | 271/276 |
| 6,272,311 | B1 * | 8/2001 | Baughman et al. | 399/341 |
| 2004/0175214 | A1 * | 9/2004 | Chung | 399/400 |

* cited by examiner

*Primary Examiner*—David H. Bollinger
(74) *Attorney, Agent, or Firm*—Lloyd F. Bean, II

(57) ABSTRACT

An apparatus for improving sheet feeding in a direction of movement to a process station, including: a contact surface having ribs spaced along contact surface in the direction of movement, apertures being defined in the space between each rib; a blower; and an air plenum for supplying a vacuum generated by the blower to the contact surface so that when an leading edge of the sheet passes by the contact surface the vacuum pulls the leading edge of the sheet towards contact surface.

6 Claims, 5 Drawing Sheets

PASSIVE VACUUM TRANSPORT

This application is based on a Provisional Application No. 60/315,422, filed Aug. 28, 2001.

This invention relates to a copier/printer employing a roll media feed apparatus and, more particularly, to passive vacuum transport.

Copying relatively large size documents such as engineering drawings and the like normally requires that the copy, media material be supplied from a roll assembly. As a result, it is necessary that the media material be cut to size from the roll being used, and for this purpose, a cut media roll supply is desirable. Typically, a cut, media roll supply of the type referred to herein includes a roll support which holds and permits the roll to be unwound as sheets are cut therefrom, and a sheet cutter such as a rotary cutter which cuts or severs the sheet material in two. Also conventional is a handling apparatus for unwinding the media material from the supply roll and advancing a length selected to the sheet cutter, and a machine control system for integrating and synchronizing operation of the various components. It is also desirable that the sheet cutter be able to cut, with the utmost reliability and accuracy, a wide range of media materials such as bond, vellum, film, tracing paper, and the like in addition to a wide range of paper weights. For example, prior art rotary bar type cutters as disclosed in U.S. Pat. Nos. 4,058,037 and 3,879,123, both of whose contents are hereby incorporated by reference.

However, major problems with roll media feeders include ensuring that the roll media lead edge enters the fuser without wrinkling leading to damage prints and increased chances of jamming.

Accordingly, the present invention provides an apparatus for improving sheet feeding in a direction of movement to a process station, comprising: a contact surface having ribs spaced along contact surface in the direction of movement, apertures being defined in the space between each rib; a blower; and an air plenum for supplying a vacuum generated by said blower to the contact surface so that when an leading edge of the sheet passes by the contact surface the vacuum pulls the leading edge of the sheet towards contact surface.

Figure 1:
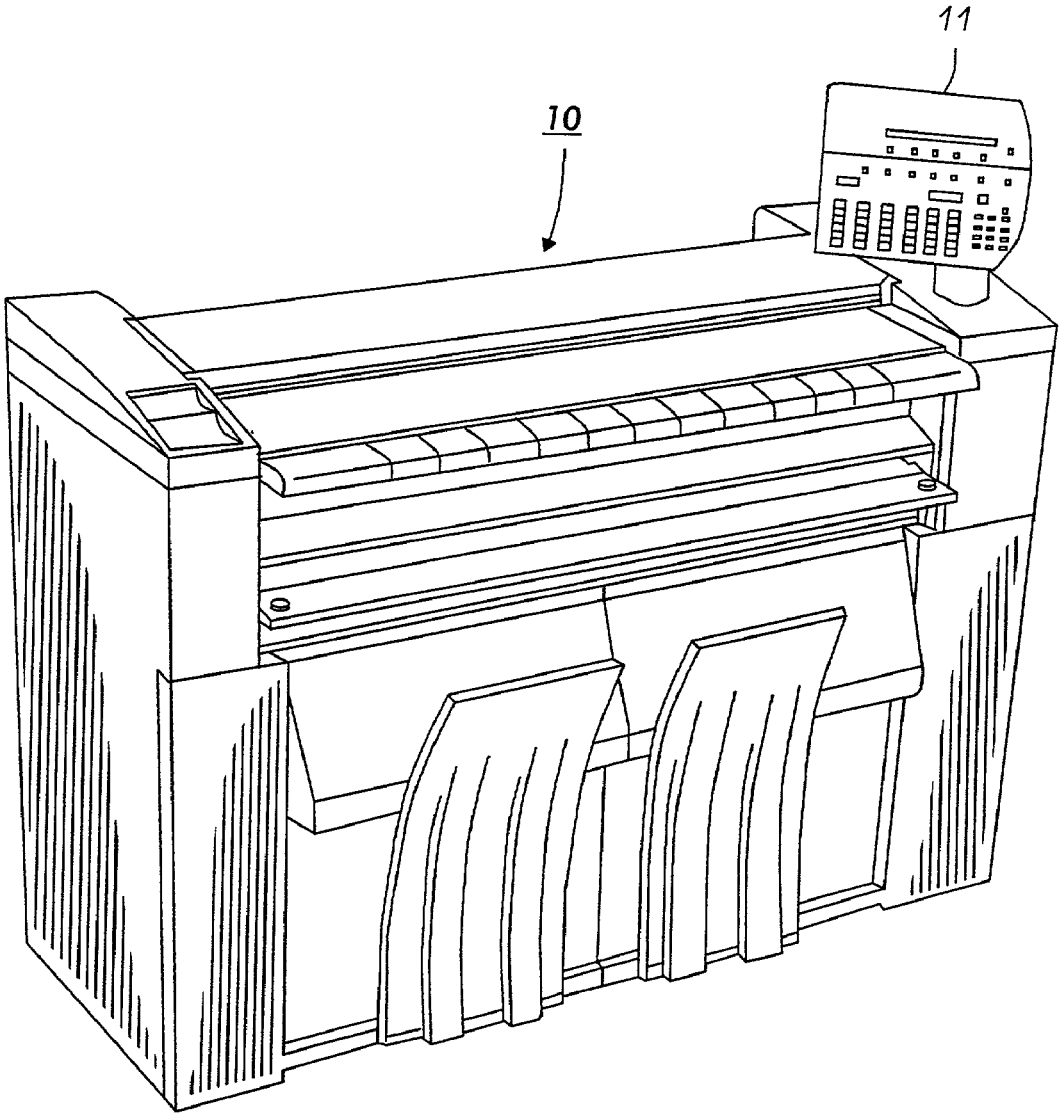
FIG. 1 is an isometric view of a copier/printer which employs the dual use sensors of the present invention.

Referring now to the drawings in detail wherein like numbers represent like elements, in FIG. 1 a wide format copier/printer 10 including a control panel 12 is shown which is especially adapted to copy large documents. Documents to be copied are fed in from the front of the machine, pass through an exposure zone and exit out of the back of the machine.

Figure 2:
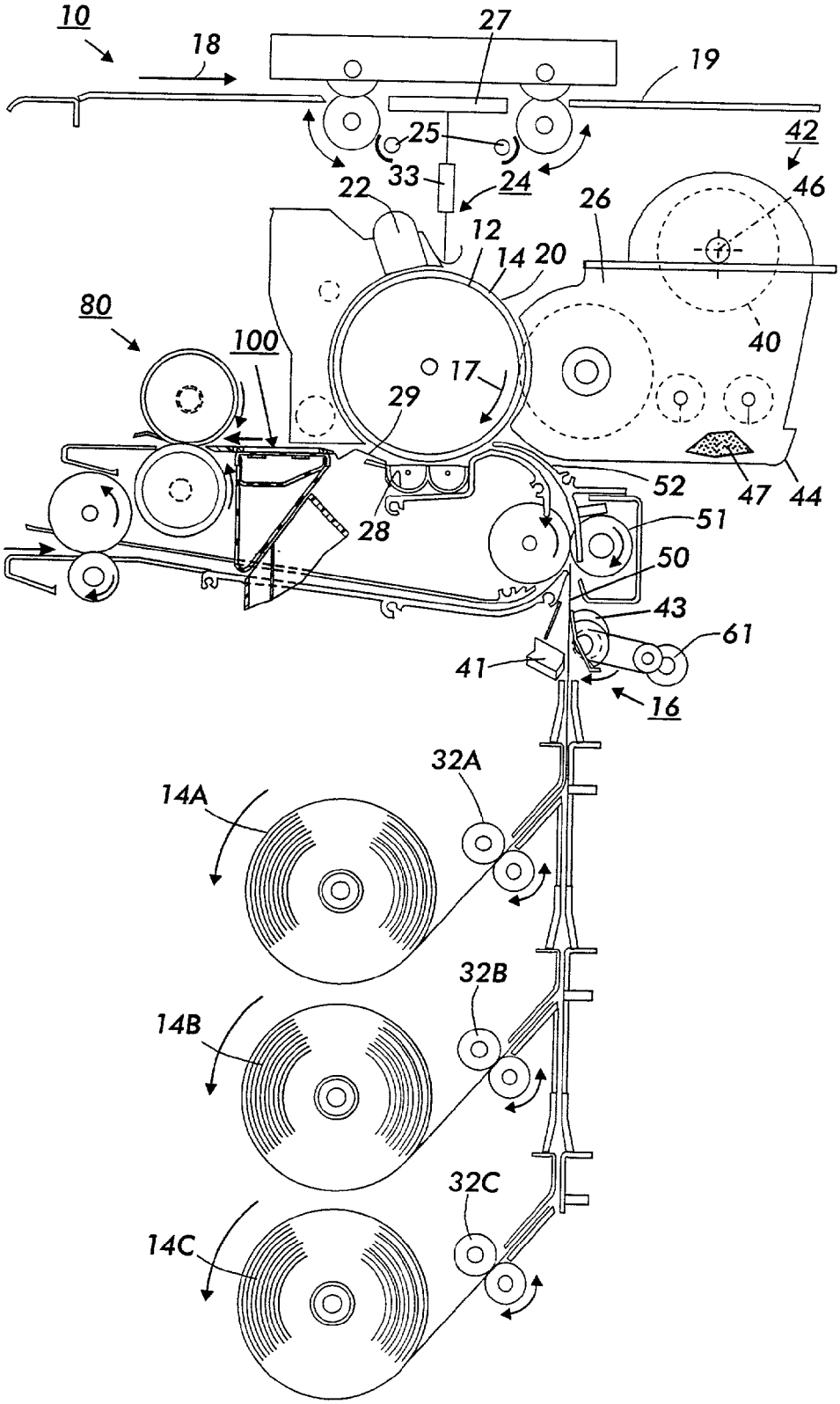
FIG. 2 is a partial, exploded, schematic side view of the copier/printer of FIG. 1 showing the placement of the dual use sensors.

FIG. 2 shows a side internal view of the copier/printer machine 10. Machine 10 includes an electrostatic drum 20 with xerographic stations arranged around its periphery, which carry out the operational steps of the copying process. These stations include charging station 22, exposure station 24, developing station 26, transfer station 28 and fusing station 30. Documents fed along the platen 19 in the direction of arrow 8 are imaged onto the surface of drum 20, at exposure station 24. The operations of the stations are conventional and are described, for example, in U.S. Pat. Nos. 4,821,974; 4,996,556; and 5,040,777, whose contents are incorporated herein by reference.

Copy media, which may be bond paper, vellum, or the like, is cut from the selected media roll assembly 14A, 14B or 14C and is fed by a respective feed roller pair 32A, 32B or 32C. The sheet to be cut is guided along a vertical path between baffle pairs into the sheet cutting bar assembly 16 which includes a stationary blade 42 and a rotating cutting bar 44 that includes a helical cutting blade. Cutter bar 44 is shown in the home position which is about 30 degrees of rotation away from the cutting position and is driven by motor 60. Cutter assembly 16 is of the type described, for example, in U.S. Pat. No. 4,058,037, referenced supra. Initiated by a cutter operation signal, bar 44 rotates in the direction of the arrow with its blade moving against blade 42 to sheer a sheet 50 from the roll media with a straight cut.

The cut sheet is transported after registration by roller pair 51 into baffle 52 and then into transfer station 28 where a developed image is transferred onto the sheet. The cut sheet is then forwarded through transfer station 30 and out of the machine.

After transfer station 28, the sheet moves to passive sheet transport 100 of the present invention and then to fusing station 80. It includes a two roll fuser where the lead edge of the sheet enters the fuser nip 81 formed by the two fuser roll. Prior to the fuser nip the lead edge of the sheet passes by passive vacuum transport 100 which flattens out the lead edge of the sheet thereby preventing wrinkling of lead edge of the sheet.

Figure 3:
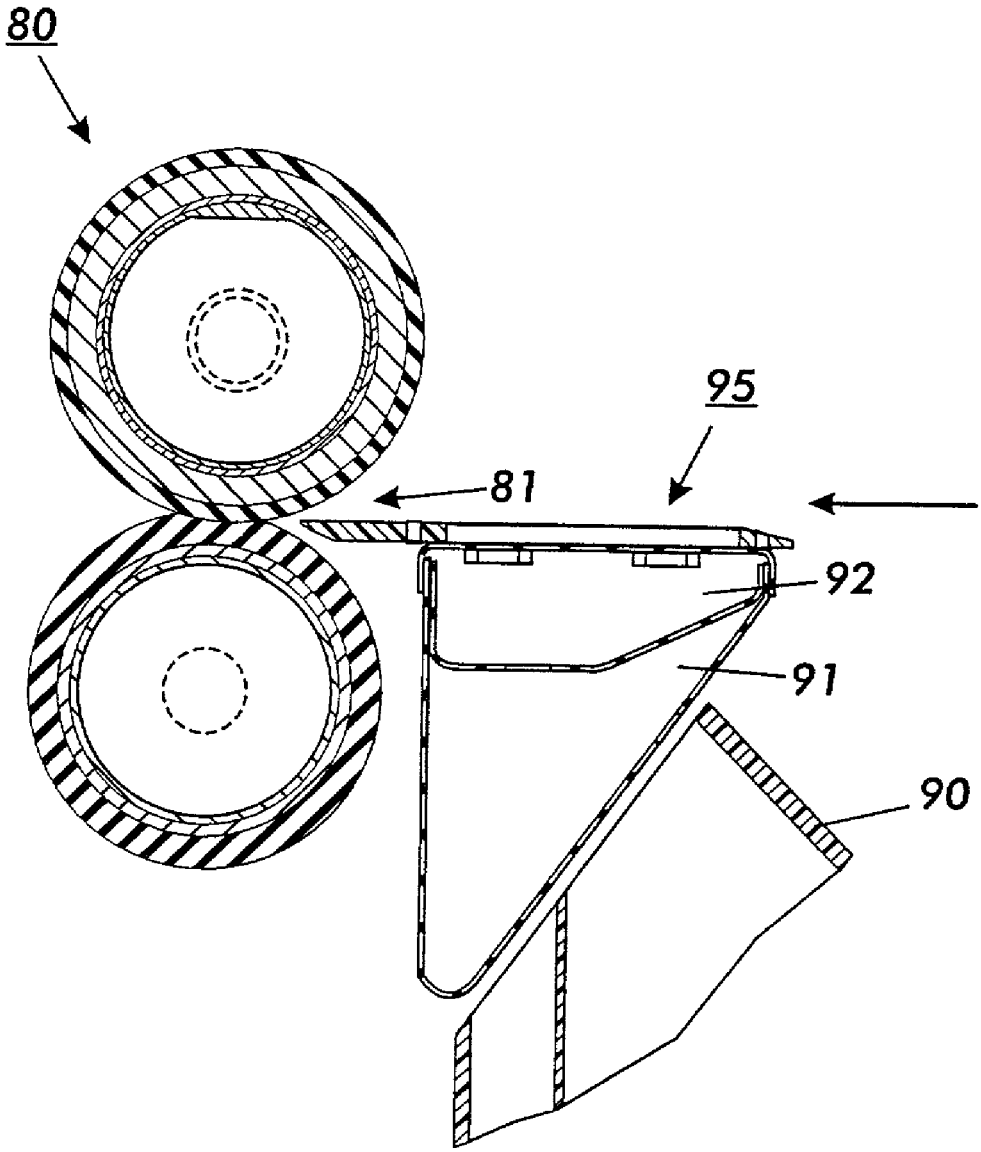
FIGS. 3–5 illustrate views of the passive transport of the present invention.
Figure 4:
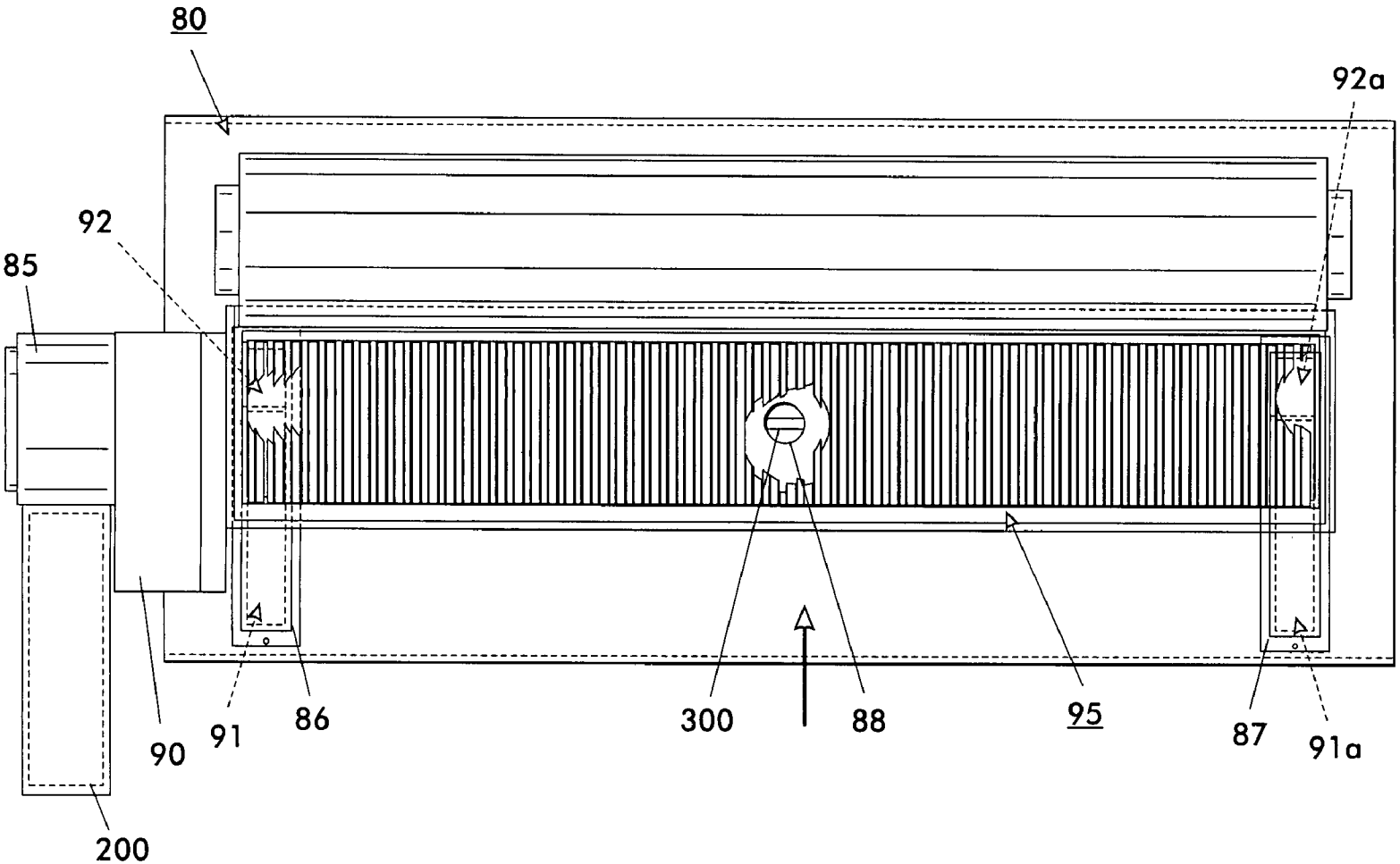
Figure 5:
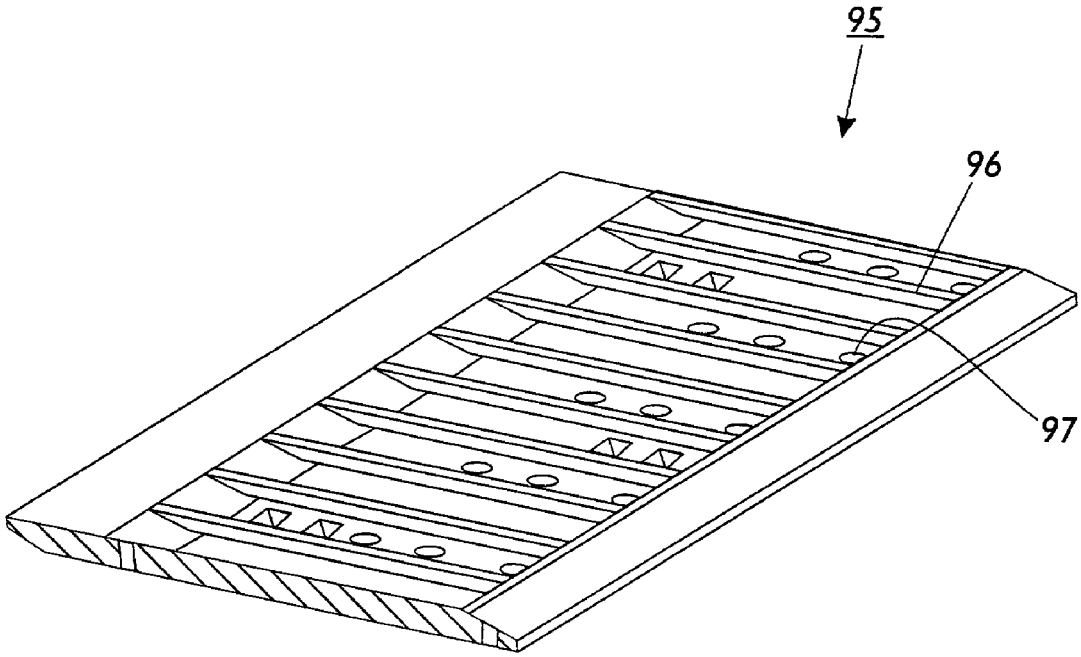

Now referring to FIGS. 3–5, Passive transport includes a contact surface 95 having ribs 96 spaced along contact surface 95 in the direction of movement of the sheet. In between the space of each rib the are apertures 97 position along the length of the ribs. An air plenum 92 supplies a vacuum generated by blower 85, in operation as the leading edge of the sheet passes by the vacuum pulls the leading edge towards contact surface 95. The top surface of the ribs are designed to minimize fictional contact; the ribs will leak air so that the sheet will not stick to the contact surface 95 but slide easily toward fuser nip thereby creating a uniform straight lead edge entering the fuser nip 81.

A feature of passive transport is the vacuum pull at the center with the largest force and less force moving a way from the center is accomplished by having a second air plenum 91 connected to air plenum 92. Air plenum 91 has two openings 86 and 87 at opposite ends thereof which supply manifold 90 connects to. Supply manifold 90 is connected to blower 85. Air plenum 91 has an opening 88 in the proximate center of contact surface 95. A controller 200 may be employed with blower to activate the vacuum when a lead edge is on contact surface, further controller 200 may also control the vacuum supplied to be varied base on the properties of the media being used (for example weight, surface smoothness, etc). Activation of the vacuum can also be accomplished by using shutter 300 on opening 88.

In recapulation, there has been provided a vacuum transport that controls media entering the fuser from the photoreceptor on a new wide format xerographic printer with a two roll fuser. This transport works without drive assisted parts. The media contact surface is ribbed in the media direction to reduce friction and allow the media to be pushed into the fuser from the photoreceptor. The lack of drive components makes this a very low cost alternative to traditional belt driven vacuum transport systems. The subsystem consists of a blower to create vacuum, ducts, gaskets, split air chamber for a center draw vacuum and ribbed vacuum platens that contact the paper.

Using segmented molded plastic parts, formed sheet metal parts, gaskets, ducts and vacuum device. The media is passed over a ribbed plastic platen. Vacuum holes between the ribs allow media to be pulled toward the platen surface. The ribbed surface is designed to minimize frictional contct to the ribs. The ribs will "leak air" so that the media will not stick to the ribbed surface but will be pulled toward the platen. In this way, the media is not drawn down tight to the entrance surface but will easily slide toward the nip. This creates a uniform straight media lead edge entering the fuser hip. The balance of vacuum and the minimum ribbed surface size are the key features that make this system unique. The vacuum pressure in the system was defined by the media type, size, and location that removed the wrinkle and maintained the lead edge.

The other unique feature is how the system can handle different paper widths. The vacuum is center drawn giving the largest vacuum pull towards the center of the paper and less pull further away from the center. As the width size gets larger, pressure losses on the sides will still pull the media toward the platen with less force then in the center. And if the paper width is smaller, the vacuum will have pressure leaks at the edges that should not significantly reduce the center vacuum force.

While the invention has been described with reference to the structure disclosed, it is not intended that the invention be confined to the details set forth, but it is intended to cover modifications or changes as they come within the scope of the following claims.

What is claimed is:

1. An apparatus for improving sheet feeding in a direction of movement to a process station, comprising:

a contact surface having ribs spaced along contact surface in the direction of movement, apertures being defined in the space between of each rib;

a blower;

an air plenum for supplying a vacuum generated by said blower to the contact surface so that when an leading edge of the sheet passes by the contact surface the vacuum pulls the leading edge of the sheet towards contact surface; and a second air plenum connected to said first mention air plenum, said second air plenum has an opening in the proximate center of contact surface.

2. An apparatus for improving sheet feeding in a direction of movement to a process station, comprising:

a contact surface having ribs spaced along contact surface in the direction of movement, apertures being defined in the space between of each rib;

a blower;

an air plenum for supplying a vacuum generated by said blower to the contact surface so that when an leading edge of the sheet passes by the contact surface the vacuum pulls the leading edge of the sheet towards contact surface; and a shutter, associate with said air plenum, for varying the vacuum.

3. The apparatus of claim 2, wherein said apparatus is positioned prior to a nip.

4. The apparatus of claim 2, wherein said apertures are positioned along an area between the length of the ribs.

5. The apparatus of claim 2, further comprising a second air plenum connected to said first mention air plenum.

6. The apparatus of claim 5 wherein said second air plenum has two openings at apposite ends thereof;

a supply manifold connects to said two openings, said supply manifold connected to said blower.

* * * * *